US005314396A

United States Patent [19]

Parr

[11] Patent Number: 5,314,396

[45] Date of Patent: May 24, 1994

[54] PERFORMANCE ALIGNMENT REACTION TOOL OF EXERCISE USING THE PERFORMANCE ALIGNMENT REACTION TOOL

[76] Inventor: Robert G. Parr, 3901 Rushton Crescent, Mississauga, Ontario, Canada, L5L 4H5

[21] Appl. No.: 848,409

[22] Filed: Mar. 6, 1992

[51] Int. Cl.[5] ..... A63B 21/02

[52] U.S. Cl. ..... 482/126; 482/121; 482/122

[58] Field of Search ..... 482/121, 122, 126, 97, 482/49, 123, 124, 125, 129, 130

[56] References Cited

U.S. PATENT DOCUMENTS

| | | | |
|---|---|---|---|
| 1,698,831 | 1/1929 | Titus | 482/126 |
| 1,749,544 | 3/1930 | Pagano | 482/126 |
| 2,930,614 | 3/1960 | McIntosh | 482/126 |
| 3,256,015 | 6/1966 | Perrin | 482/121 |
| 3,312,466 | 4/1967 | Melchiona | 482/136 |
| 3,618,942 | 11/1971 | Bates | 482/129 |
| 4,600,190 | 7/1986 | Berokoff | 482/129 |
| 4,783,067 | 11/1988 | Palmer | 482/122 |

*Primary Examiner*—Richard J. Apley
*Assistant Examiner*—Lynne A. Reichard
*Attorney, Agent, or Firm*—Gifford, Groh, Sprinkle, Patmore and Anderson

[57] ABSTRACT

A performance alignment reaction tool consisting of a control bar, an alignment bar and a length of elastic material elastically connecting the control bar to the alignment bar. The length of elastic material is connected to holes provided adjacent to the ends of the control bar and a hole centrally disposed through the alignment bar in a generally triangular pattern. In alternate embodiments, the performance alignment reaction tool may include a guide arm provided at one end of the alignment bar and a range of motion guide for locating the position of the alignment bar and the hand holding the alignment bar relative to the body. In the use of the performance alignment reaction tool, the control bar is grasped in one hand and the alignment bar is grasped in the other hand. The control bar and the alignment bar are extended towards predetermined points in space in a repetitious alternating sequence with the body turning towards each point in space to which the control and alignment bars are extended.

22 Claims, 5 Drawing Sheets

PERFORMANCE ALIGNMENT REACTION TOOL OF EXERCISE USING THE PERFORMANCE ALIGNMENT REACTION TOOL

BACKGROUND OF THE INVENTION

1. Field of the Invention

The invention is an exercise/alignment tool and a method of execution using the exercise/alignment tool and in particular the invention consists of at least two bars disposed at right angles to each other and connected by elastic members such as to maximize the alignment of the body or structure of the body which in turn maximizes speed, power and timing of hand and body movement along vault lines of the body without loosing balance.

2. Prior Art

For health and body building reasons, there is currently a plethora of exercise machines and devices available to the public. Most of these machines and devices are for the purpose of developing the body and for increasing the size or strength of a particular muscle or muscle group. There are the conventional weight lifting machines which can be used to develop the arm, leg or chest muscles. Alternatively, there are stationary exercise bikes, treadmills, rowing and cross-country ski devices. These latter devices are for increasing arm and leg strength as well as for increasing arm and leg coordination. Performance of the individual is improved based on size and strength of muscles, not structural alignment of the body i.e. as is done in training boxers.

Various types of portable exercise devices for the development of hand, wrist, arm and shoulder muscles as well as other parts of the body are currently available from a variety of sources. Typical of these types of exercise devices is the simple expander taught by Ullmann in U.S. Pat. No. 5,020,796 which comprises one or more elastic strands having a hand loop provided at each end which serves as hand grips. U.S. Pat. No. 4,872,671, issued to Brandell, teaches an exercise device which provides varied and predetermined distance. A pair of elongated tubular handles are interconnected by resilient means which applies a variable resistance against the handles. Alternatively, Sleichter, III et al in U.S. Pat. No. 4,852,874 teaches a Portable isokinetic exercise device comprising an endless loop of elastic material having a pair of generally tubular handles on opposite sides thereof. An elastic sleeve surrounds the intermediate portion of the loop between the handles.

Another type of expander device is taught by Leung et al in U.S. Pat. No. 5,026,050 in which the elastic strands are replaced by a coil spring having legs extending from each end thereof. A wrist exercise device is taught by Nolan in U.S. Pat. No. 4,973,043 having non-aligned hand grips which are rotatably spring biased, so that the wrist action to rotate one hand grip is independent of the wrist action to rotate the other handle. Krausz in U.S. Pat. No. 4,603,854 teaches a trunk exercise device having a shaft with a pair of spatially separated upstanding handles on opposite sides of the users body. A fan type blade is adjustably attached to each end of the shaft to provide air resistance to the movement of the shaft with a twisting of the users trunk. Another type of exercise device is the arm exercise device taught by Greenberg in U.S. Pat. No. 4,869,495. This device comprises a ball tethered to a collar receivable about the neck of the user. The ball is to be tossed back and forth between the hands of a runner or jogger as he or she runs or jogs to exercise the arms and upper torso.

SUMMARY OF THE INVENTION

The invention is a performance alignment reaction tool and a method of exercise using the performance alignment reaction tool. In its basic form, the performance alignment reaction tool consists of a control bar and an alignment bar generally disposed at right angles to each other. The control bar and the alignment bar are resiliently connected to each other by a length of elastic material which is threaded through a hole provided adjacent to each end of the control bar and at least one hole provided in the alignment bar such that the length of elastic material forms at least two sides of an isosceles triangle of equal length. Preferably the control bar has a set of through holes at each end and the alignment bar has a corresponding set of holes, so that the size of the triangle formed by the length of elastic material may be varied to increase or decrease the tension forces restraining the physical displacement of the control and alignment bars relative to each other. The length of elastic material may be in the form of a continuous loop or its ends may be attached to the ends of the control bar.

The equal lengths of the sides of the triangle formed by the loop of elastic material produce equal and opposite lateral forces tending to guide the displacement of the control and alignment bars relative to each other in a plane which passes through the center of the control bar and perpendicular therethrough. The length of elastic material may consist of one or more strands of solid latex or rubber, a latex tube, or a combination thereof in which at least one strand of solid elastic material may be threaded into a latex tube. Alternatively, the solid elastic material inside the latex tube may be replaced by a coiled nylon line. Preferably the ends of the length of elastic material are tied to each other to form a loop. This permits the user to adjust the tension produced by the elastic material to suit the exercise routine for the desired muscular and reaction development.

One alternate embodiment of the performance alignment reaction tool includes a guide arm which is symmetrically disposed at the end of the alignment bar. The guide arm is perpendicular to the alignment bar and has a pair of holes adjacent to each end thereof through which the loop of elastic material is threaded. The guide arm is preferably pivotably attached to the end of the alignment bar, but may be fixedly attached to the alignment bar to enhance wrist development.

In a second alternate embodiment, outrigger bars are attached to each end of the control bar. The outrigger bars are substantially parallel to each other and to the alignment bar. Holes are provided at each end of the outrigger bars through which the loop of elastic material is threaded.

In the use of the performance alignment reaction tool, the control bar is grasped in one hand and the alignment bar is grasped in then other hand. Preferably, the user then sights a predetermined target or point in space the repetitively extends the alignment bar and control bar towards the sighted point in an alternating sequence. This motion pivots the body with the movement of the hands. The use of the performance alignment reaction tool develops perfect alignment of the action and reaction towards the sighted point in space. Alternatively, the repetitive extension of the alignment and control bars may be in a specific direction relative to the body, eliminating the necessity of sighting a point in space. The use of the performance alignment reaction tool conforms to how the body moves which make them very useful for developing actions and reactions for exercise or sport purposes.

In the preferred method of use of the performance alignment reaction tool, the user sights, one at a time, a plurality of points in space, then turns his body to face the slighted point in space while extending the control bar or the alignment bar in an alternating sequence towards the sighted point in space.

A pattern having numerals of a predetermined numerical sequence printed thereon may be placed in front of the user. In use of this pattern, each numeral represents a point in space, the numerals are sighted in there numerical sequence, then the control bar and the alignment bar is extended towards the sighted numeral in an alternating sequence.

The object of the invention is a method of exercise using the performance alignment reaction tool to improve a user's ability to act and react with optimum speed, timing and power while retaining balance.

Another object of the method of exercise is to develop the alignment of the hands and body along predetermined vault lines.

Another object is to improve reaction performance with structural alignment as the base.

Another object of the invention is to develop a muscular structure that will develop and/or restore the individual's skeletal structure which will enable the individual to enjoy a well balanced and functional range of motion.

These and other objects of the invention will become more apparent from the reading of the detailed description of the invention in conjunction with the drawings.

FIGS. *29a–29d* show the sequential relationship of the body, and the hands relative to two different sighted points in space.

Figure 30:
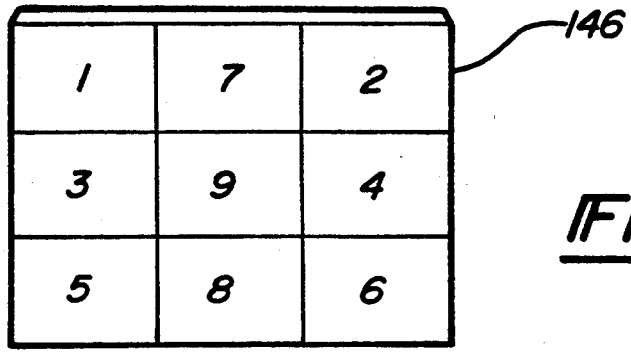

FIG. 30 shows a starter pattern for use with the performance alignment reaction tool.

Figure 31:
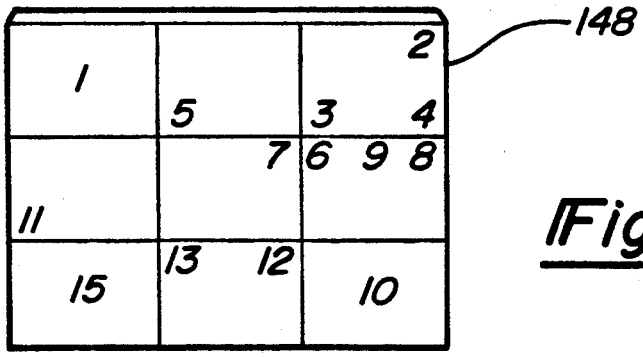

FIG. 31 shows an intermediate pattern for use with the performance alignment reaction tool.

Figure 32:
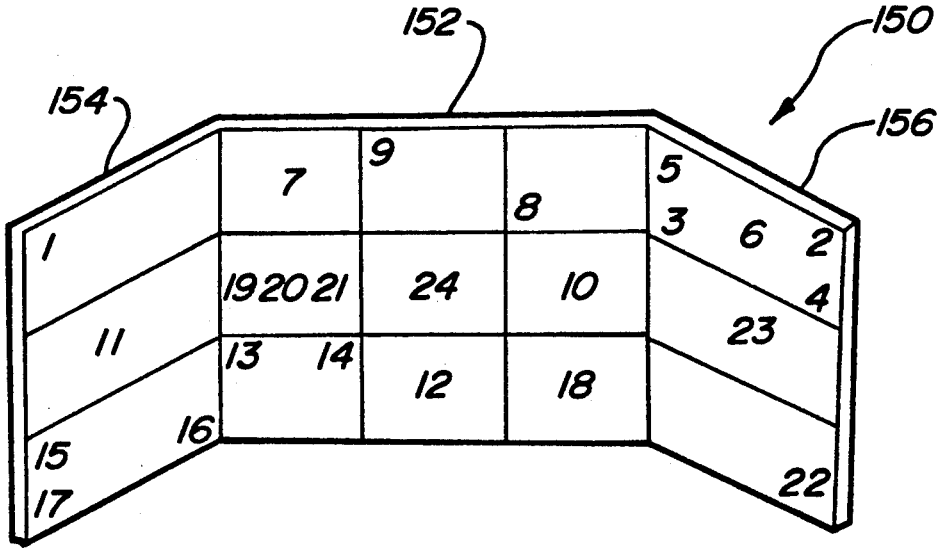

FIG. 32 shows an advanced pattern for use with the performance alignment reaction tool.

DETAILED DESCRIPTION OF THE INVENTION

The invention is a performance alignment reaction tool and a method of execution using the performance alignment reaction tool to improve one's ability to act and react with optimum speed, timing, and power while maintaining balance. The details of the structure of the performance alignment reaction tool will be discussed relative to various embodiments shown in FIGS. 1 through 28 and the method of using the performance alignment reaction tool will be shown in FIGS. *29a* through *29d*.

Figure 1:
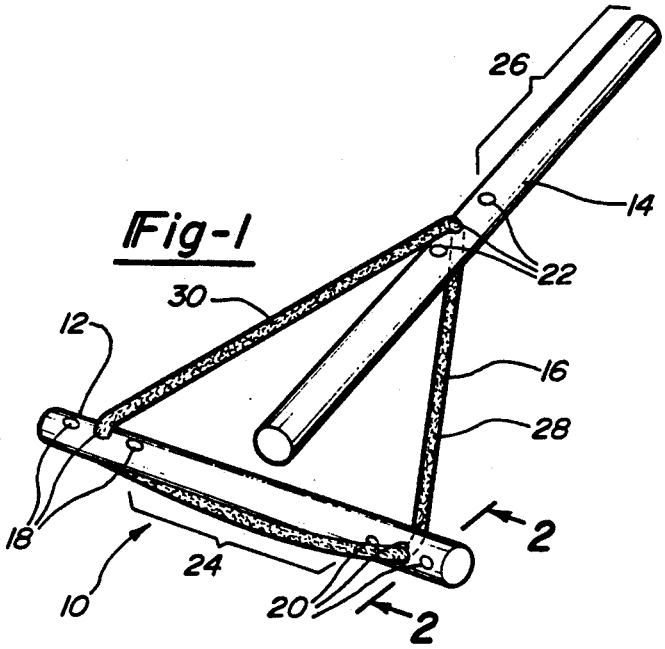
FIG. 1 is a perspective showing the details of a basic embodiment of the performance alignment reaction tool.

The basic embodiment of the performance alignment reaction tool 10 is shown in FIG. 1. the performance alignment reaction tool 10 consists of a control bar 12 and an alignment bar 14 connected to each other by a length of elastic material 16. The control bar 12 has a first plurality of through holes 18 provided through one end thereof. The second plurality of holes 20 at the opposite end of the control bar 12 are disposed normal to the first plurality of holes 18 as shown more clearly in FIG. 2. Although the holes 18 and 20 are preferably at right angles to each other, they alternatively may be parallel to each other and to the alignment bar 14 as shown on FIGS. 8, 9 and 17.

Figures 17, 18, 19, 20, 21, 22, 23, 24, 25, 26, 27, 28:
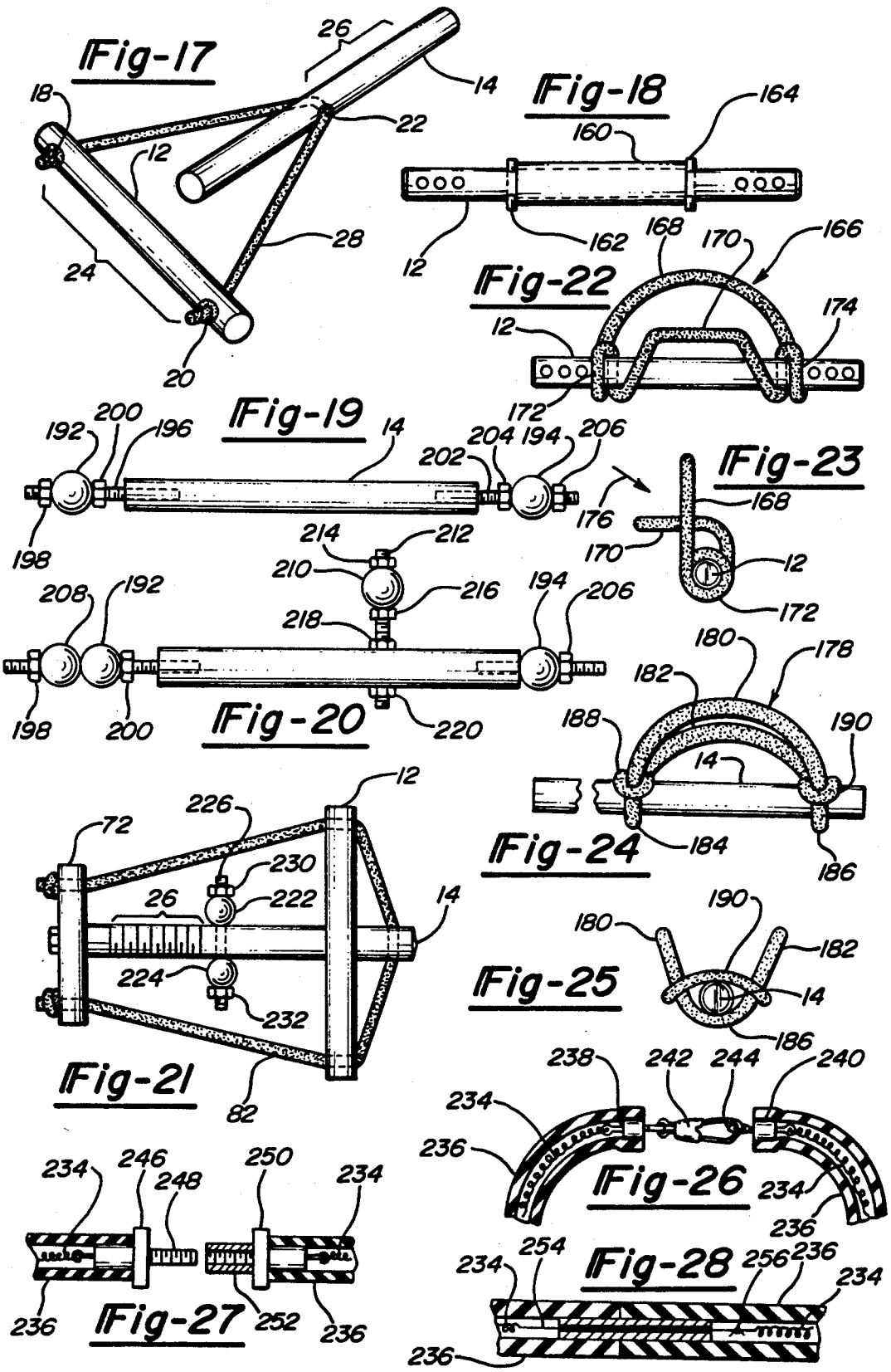
FIG. 17 is a perspective view of the performance alignment reaction tool in which the ends of the elastic material are fixedly attached to the control bar.
FIG. 18 is a side view of the control bar having an attached rotatable hand grip.
FIG. 19 is a side view of the alignment bar having axially aligned counter balance weights attached to its opposite ends.
FIG. 20 is a side view of the alignment bar having axial aligned counter balance weights and a radially disposed counter balance weight.
FIG. 21 is a plan view of the performance alignment reaction tool of FIG. 8 having a pair of radially disposed counter balance weights.
FIG. 22 is a side view of a control bar safety guard attached to a control bar.
FIG. 23 is an end view of the control bar safety guard.
FIG. 24 is a side view of an alignment bar safety guard.
FIG. 25 is an end view of an alignment bar safety guard.
FIG. 26 is a partial cross section showing a nylon insert inside of the latex tubing and a safety latch connecting the ends of the nylon insert and the latex tubing.
FIG. 27 is a partial cross section showing a screw connection for connecting the ends of the nylon insert and latex tubing.
FIG. 28 is a partial cross section showing a hollow connector for connecting the ends of the latex and the nylon insert passing therethrough.

The alignment bar 14 also has a plurality of centrally disposed through holes 22. The length of elastic material 16 is threaded through, one each, of the holes 18, 20 and 22 form an elastic isosceles triangle as shown in FIG. 1, in which the two side portions 28 and 30 are substantially equal. Alternatively, the ends of the length of elastic material 16 may be fixedly attached to the ends of the control bar 12 as shown in FIG. 17. The control bar 12 has a hand grasping portion 24 and the alignment bar 14 has a corresponding hand grasping portion 26. In normal use of the performance alignment reaction tool, the control bar 12 is held normal to the alignment bar 14. Due to the triangular configuration of the length of elastic material 16 as the control bar 12 is displaced away from the alignment bar 14 and is held normal thereto, the portions 28 and 30 of the length of elastic material 16 passing through holes 18 and 20 respectively produce opposing lateral forces maintaining the direction of travel of the control bar 12 along a plane normal to the axis of the control bar. This displacement of the control bar 12 away from the alignment bar 14 produces a directed motion of travel along a predetermined path or vault line as shall be explained hereinafter.

As a result of the triangular shape of the length of elastic material, it is obvious to one skilled in the art, the displacement of the alignment bar 14 relative to the control bar 12 would produce the same result and the portions 28 and 30 of the length of resilient material 16 would produce opposing forces again producing a directed motion along the same predetermined path. Thus exercising with the performance alignment reaction tool is not only a muscle development exercise, but also trains the person to utilize these muscles along a directed path of motion or vault line.

In the preferred embodiment, the control and alignment bars are made from a structural plastic, but may be made from wood, aluminum, steel or any other suitable material. The bars may be made in various sizes to emphasis or particularly develop muscular reactions in a predetermined direction, i.e. along a vault line as shown in the chart below for an average size male user:

| Size | Length of Bars | Muscle Response |
|---|---|---|
| Small | 9–10 inches | wrist, forearm & elbows |
| Medium | 12–14 inches | shoulders and arms |
| Large | 18–20 inches | entire body, preferably the mid-section |

It is to be recognized that the length of the control and alignment bars given in the above chart are for an average male user, however, the size ranges would change for use by a child, a female, or a larger than average person. In general, the performance alignment reaction tool, to be ultimately effective can be tailored for the size of the user as well as whether they are male or female.

Accordingly, the diameters of the control and alignment bars will also be variable for both female and male users. In particular, the diameters of the control and alignment bars for female users may vary from ½ inch to 1 inch while for male users may vary from 1¼ inch to 1½ inch dependant upon the size of the users hands and the intent of muscle development area (smaller dia. for finger & hand & wrist development, larger dia. engages forearm, bicep, shoulder).

The length of elastic material may be a solid or tubular, rubber, latex or any other suitable elastic material which will not be permanently deformed upon the full extension of the users arms. Preferably, the length of elastic material 16 may comprise one or more strands of solid or tubular elastic material connected at its ends and include a solid rubber or nylon insert for safety purposes. The size of the loop formed by the elastic material may then be varied by the user to produce the desired resistive or tension force to the displacement of the control bar 12 from the alignment bar 14 and vice versa. The length of elastic material 16 may be a single length or loop as shown but may comprise two or more lengths or loops to increase the resistive force when desired.

Figure 3:
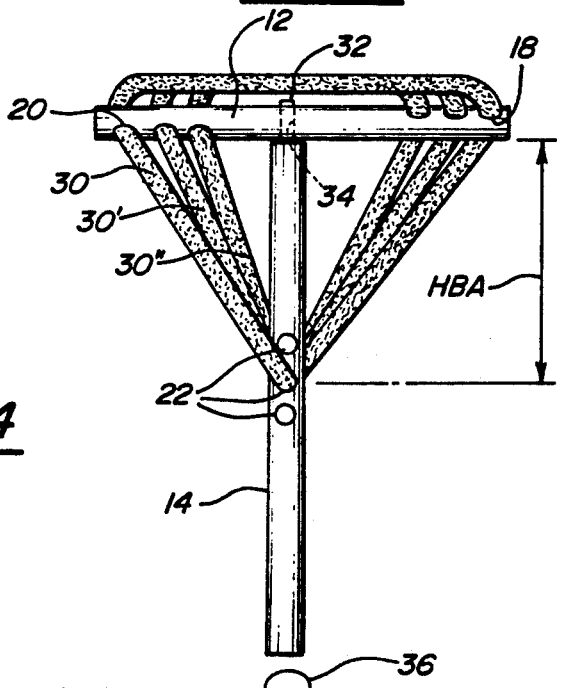
FIG. 3 is a top view showing an alternate arrangement of the loop of elastic material.

A variation of the embodiment of the performance alignment reaction tool 10 is shown in FIG. 3. In this variation, to produce the desired resistive or tension force to the displacement of the control bar 12 from the alignment bar 14 and vice versa. The length of elastic material 16 may be a single length or loop as shown but may comprise two or more lengths or loops to increase the resistive force when desired.

Figure 2:
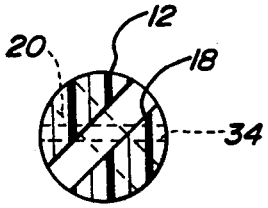
FIG. 2 is a cross section of the control bar showing the angular relationship of the holes therethrough.

A variation of the embodiment of the performance alignment reaction tool 10 is shown in FIG. 3. In this variation, the control bar 12, and the alignment bar 14 are essentially the same as shown in FIG. 1 and therefore have the same reference numerals. In this variation of the performance alignment reaction tool, multiple lengths of elastic material may be threaded through the holes 18, 20 and 22 as shown to increase the tension force. This embodiment also includes a pin 32 extending from the end of the alignment bar 14 rotatably received in a through aperture 34 provided in the center of the control bar 12. The through aperture 34 is preferably disposed 45° relative to holes 18 and 20 as shown in FIG. 2. This arrangement permits the alignment bar 14 to be rotated relative to control bar 12, as indicated by double headed arrow 36, against the force of the loop of the resilient material 16, to exercise the wrists.

Further illustrated in FIG. 3 is the "hand body alignment" (HBA) distance. The hand body alignment (HBA) distance is a desired positional relationship of the hands from each other in relationship to the body while using the performance alignment reaction tool.

Figure 4:
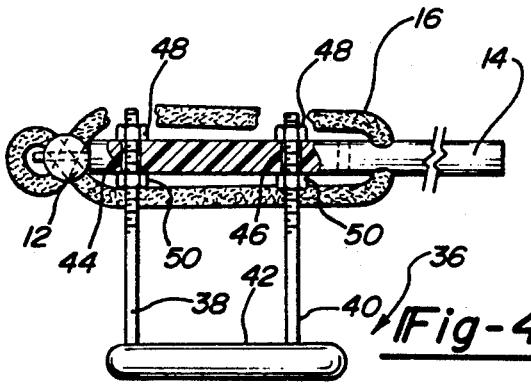
FIG. 4 is a side view showing a range of motion guide attached to the alignment bar.
Figure 5:
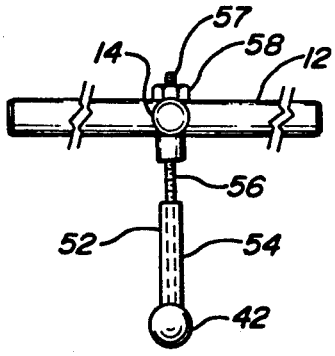
FIG. 5 is a frontal view of the embodiment shown in FIG. 4.

The embodiments of the performance alignment reaction tool 10 shown in FIGS. 1 and 3 may include a range of motion guide 36 as shown in FIGS. 4 and 5 to aid and assist the user in the placement of the alignment bar 14 relative to the body of the user. The range of motion guide 36 may consist of a pair of legs 38 and 40 connecting a body rest member 42 to the alignment bar 14 as shown in FIG. 4.

One end of each leg 38 and 40 is connected directly to the body rest member 42 and the other end is received through mating apertures 44 and 46 provided through the alignment bar 14. The apertures 44 and 46 are preferably parallel to the apertures 22. The ends of the legs 38 and 40 opposite the body rest member 42 are threaded as shown and are locked to the alignment arm 14 by a pair of nuts 48 and 50 as shown. This arrangement permits the distance between alignment bar 14 and the body rest member 42 to be adjusted to suit the particular user, or training program requirements.

Alternatively, as shown in FIG. 5, the legs 38 and 40 may consist of a pair of telescoping members arms 52. Each telescoping member arm consists of a cylindrical portion 54 connected to the body rest member 42 and mating portion 56 having a threaded end 57. The threaded end of the mating portion 56 is received through an aperture provided in the alignment bar 14 such as apertures 44 and 46 and is locked in place by a nut 58. The telescoping members may be of the twist lock type in which the rotation of the mating portion 56 within the cylindrical portion 54 will lock the mating portion to the cylindrical portion.

In the embodiments shown in FIGS. 4 and 5, the body rest member 42 may be made from the same material as the control and alignment bars. Preferably, however, the body rest member 42 is padded or covered with a soft resilient material so that its contact with users body will not bruise or otherwise produce any physical injury to the user. Although, FIGS. 4 and 5 show the use of two legs 38 and 40, it is recognized that in some embodiments of the performance alignment reaction tool, a single leg may be used.

Figure 6:
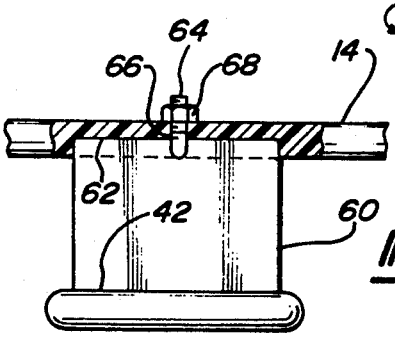
FIG. 6 shows an alternate embodiment of the range of motion guide.

FIG. 6 shows a still further embodiment of the range of motion guide 36 in which the body rest member 42 is attached to a spacer plate 60. The opposite end of the spacer plate 60 is received in a slot 62 provided in the alignment arm 14. The spacer plate 60 may be secured in the slot 62 by any means known in the art, such as the threaded post 64 attached to the top edge of the spacer plate 60 which passes through an aperture 66 provided in the alignment bar 14 and secured by nut 68.

Figure 7:
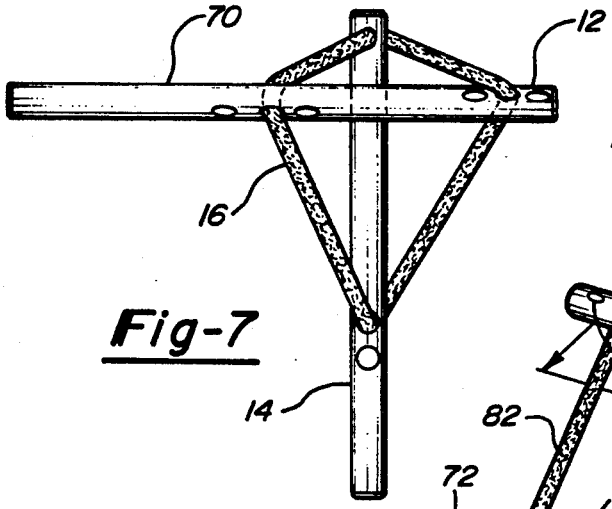
FIG. 7 is an alternate embodiment in which the hand grip portion of the control bar is offset from the loop of elastic material.

An alternate embodiment of the performance alignment reaction tool 10 is shown in FIG. 7. In this embodiment, the control bar 12 has a lateral extension 70 which permits the control bar 12 to be grasped outside of the length of elastic material 16. Also, in this arrangement, the length of elastic material may be connected in a diamond as shown, but may be connected in a triangular pattern similar to FIG. 1. This embodiment further exercises the wrist muscles to maintain the hand grasping the control bar 12 perpendicular to the direction of motion.

Figure 8:
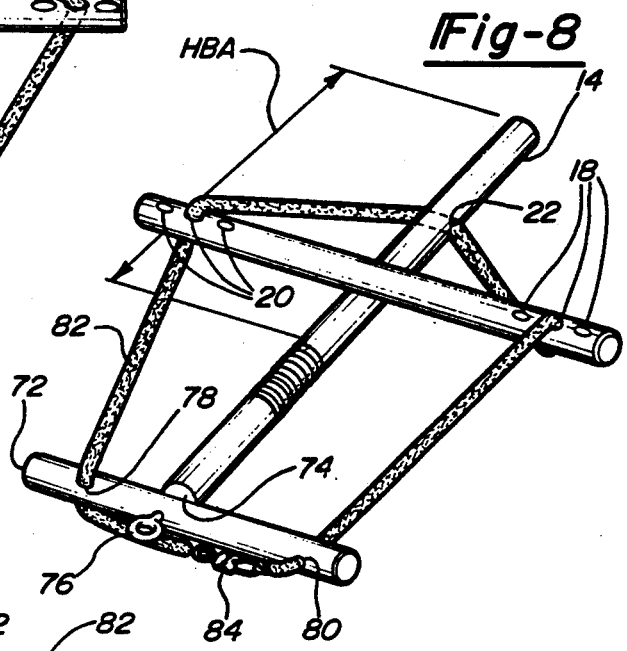
FIG. 8 is a perspective of an alternate embodiment having a guide arm attached to the alignment bar.

Still another embodiment of the performance alignment reaction tool is shown in FIG. 8. In this embodiment, a guide arm 72 substantially parallel to control arm 12 is pivotably attached to the base end 74 of the alignment bar 14 by means of a bolt, such as eye bolt 76. The guide arm 72 has a pair of through holes 78 and 80 which are preferably disposed normal to each other as shown but may be parallel to each other as previously discussed.

A length of elastic material 82 extends through hole 78 provided in one end of the guide arm 72 then passes through one of the holes 20 provided adjacent to one end of control bar 12 and one hole 22 of alignment bar 14. The length of elastic material 82 then continues through one of the holes 18 provided in the other end of the control bar 12 then through hole 80 provided in the other end of the guide arm 72. The two ends of the length of elastic material 82 are connected by means of a clip pin 84 preferably at a location between holes 78 and 80 as shown.

Figure 14:
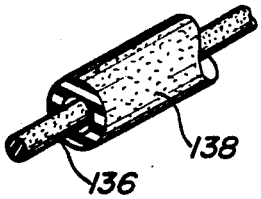
FIG. 14 is a cut away view showing a solid elastic member inside a tubular elastic member.

The length of elastic material 82 may be a length of solid rubber or latex or may be a length of latex tubing as discussed relative to FIG. 1. Also, the length of elastic material 82 may comprise a single strand or multiple strands of elastic material. As shown in FIG. 14, the length of elastic material 82 may comprise a length of solid elastic material 136 disposed in a length of latex tubing 138. In this embodiment, the length of solid elastic material 136 inside the elastic tubing preferably has modulus of elasticity greater than the latex tubing 138 so that if the latex tubing 138 breaks, the length of solid elastic will prevent the broken ends of the latex tubing 138 from snapping back and injuring the user.

As shown in FIG. 26, a coiled length of solid nylon or metal line 234, such as a 15 or 30 pound test fishing line or a braided copper line, may be inserted into the length of elastic tubing 236. The coiled line 234 has a length selected to permit full extension of the control bar from the alignment bar so as not to impede or limit the user's full range of motion. The opposite ends of the nylon line 234 are secured to line terminals 238 and 240 which are fixedly attached to the opposite ends of the elastic tubing 236 using any method known in the art. A spring clip 242 is attached to line terminal 238 and connects to an eye hook 244 attached to line terminal 240. The inserted nylon line 234 prevents free end whipping of the latex tubing in the event the latex tubing fractures or breaks during the use of the performance alignment reaction tool. This will prevent the broken or free ends of the latex tubing from hitting the user in the face or other parts of the user's arms or body, resulting in injury to the user.

In an alternate embodiment, shown in FIG. 27, one end of the coiled line 234 is connected to the internal end of a line terminal 246 fixedly attached to one end of the latex tubing 236. The external end of the line terminal 246 has an axially disposed externally threaded shaft 248. The other end of the coiled line 234 is attached to the internal end of a line terminal 250, which is fixedly attached to the opposite end of the latex tubing 236. An internally threaded cylinder 252 extends from the external end of line terminal 250. The opposite ends of the latex tubing are connected to each other by threading the threaded shaft 248 into the internally threaded cylinder 252.

In the alternative, as shown in FIG. 28, one end of the coiled nylon line 234 is threaded through a cylindrical connector 254 then tied to the opposite end of the coiled nylon line as indicated at 256. The opposite ends of the elastic tubing are then fixedly attached to the cylindrical connector 254 using any means known in the art.

To increase or delete tension, the user will simply add or subtract predetermined lengths and strengths of elastic members.

Hand body alignment (HBA) distance is calculated from the user's hand placement 15 on the alignment bar 14 to the end of the alignment bar. The hand body alignment (HBA) distance can be adjusted to suit the individual user by using different lengths of alignment and control bars.

Figure 9:
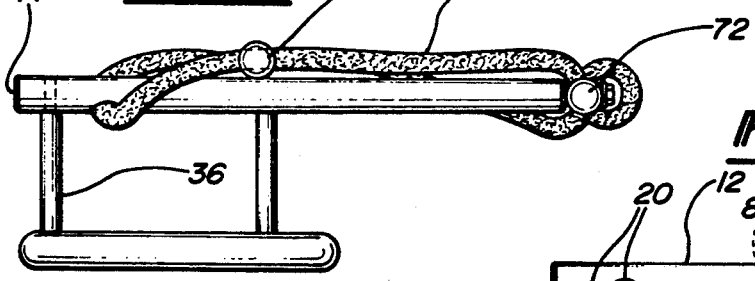
FIG. 9 is a side view of the embodiment shown in FIG. 7 having a range of motion guide.

As shown in FIG. 9, the embodiment shown in FIG. 8 may include a range of motion guide 36 as discussed relative to FIGS. 4, 5, and 6.

Figure 10:
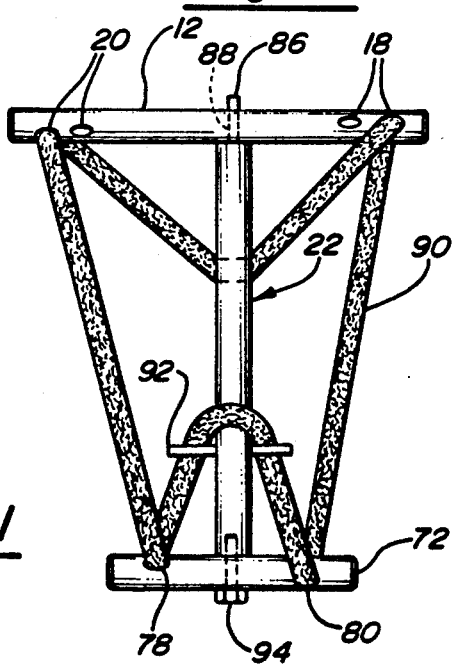
FIG. 10 is an alternate embodiment of the performance alignment reaction tool, having a different arrangement of the length of elastic material.

In the embodiment shown in FIG. 10, the length of elastic material 90 is threaded through the holes 18, 20, 22, 78 and 80 in a butterfly pattern as shown. The pattern of the loop of elastic material 90 is substantially the same as shown in FIG. 8 but includes an addition triangular section which is looped under a tension pin 92, then over the alignment bar 14 as shown. As in the embodiment shown in FIG. 8, the guide arm 72, preferably, is swivably attached to the end of alignment bar 14 by means of a threaded bolt 94 or a threaded eye bolt, such as eye bolt 76 shown in FIG. 8. However, for forearm and wrist development, the guide arm 72 may be rigidly (non-swivably) attached to the end of the alignment bar 14.

The tension pin 92 is pressed into an aperture provided in the alignment bar 14 in line with the aperture 22. The tension pin 92 extends radially on opposite sides of the alignment bar 14. The length of elastic material may be wound around the tension pin 92 to increase the tensions force of the elastic material 90 which resists the displacement of the control bar 12 relative to the alignment bar 14. The tension pin may also serve as a hand placement guide and stop which prevents the hand from slipping longitudinally along the alignment bar 14 when the control bar 12 is displaced away from the alignment bar. It can also act as a support for counter weight balls as shown in FIG. 21.

Figure 11:
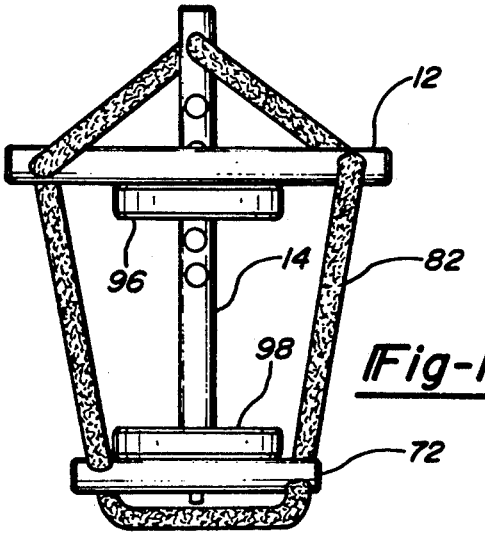
FIG. 11 shows weights added to the embodiment of FIG. 8.

The embodiment shown in FIG. 11 is substantially the same as shown in FIG. 8 and includes a pair of weights 96 and 98 attached to the alignment bar 14. Although 2 weights, weights 96 and 98, are shown, it is intended that this embodiment not be limited to two weights. If desired, only one weight may be used, or auxiliary weights may be added to the two shown as desired by the user.

Figure 12:
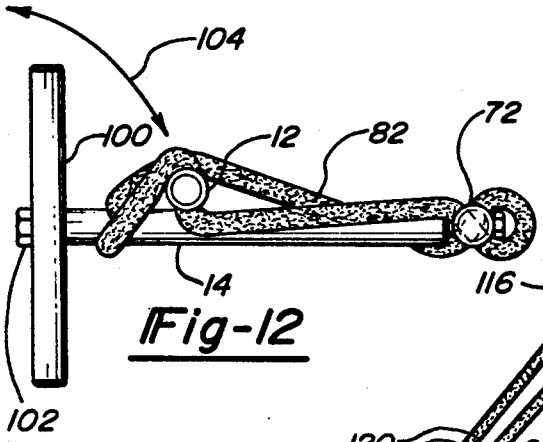
FIG. 12 shows an embodiment having a cross member disposed at the opposite end of the alignment bar.

In the embodiment shown in FIG. 12, a cross member 100 is fixedly attached by bolt 102 to the end of the alignment bar 14 perpendicular to the control bar 12 such that the control bar 12 must be raised over the end of cross member 100 in an arcuate manner as indicated by arrow 104, when the control bar 12 is displaced forward of the alignment bar 14. As in the previous embodiments, the length of elastic material 82 maintains the movement of the control bar 12 in a plane defined by the center of the control bar 12 and hole 22 in the alignment bar 14 through which the loop of elastic material 82 passes through. This provides for a precise arcuate movement within a desired plane.

Figure 13:
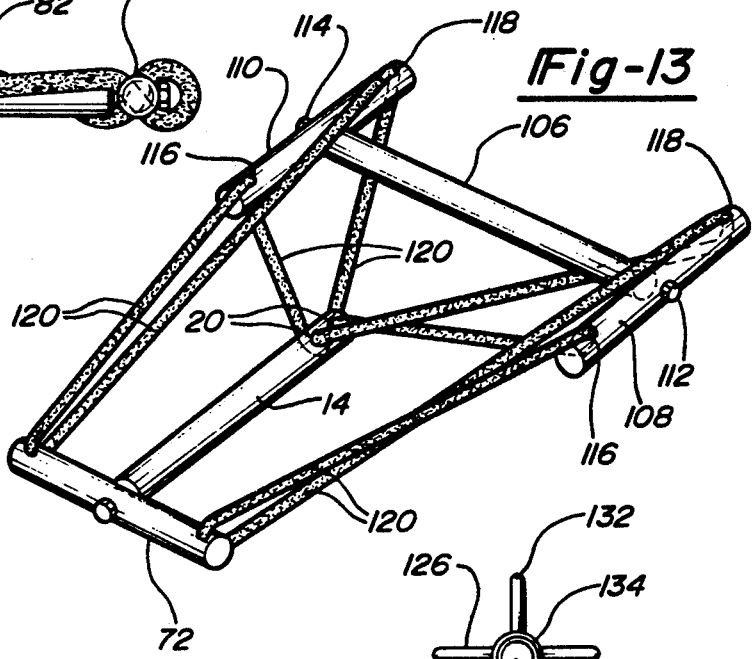
FIG. 13 shows a perspective of an alternate embodiment of the control bar.

FIG. 13 illustrates an alternate embodiment of the performance alignment reaction tool shown in FIG. 8 and includes an alignment bar 14, and a guide arm 72. The control bar 106 has a pair of outrigger bars 108 and 110 attached to its ends as shown. The outrigger bars 108 and 110 are substantially perpendicular to the axis of the control bar 106 and may be formed integral with the control bar 106. Preferably the outrigger bars 108 and 110 are separate elements which are attached to the ends of the control bar 106. The outrigger bars 108 and 110 may be fixedly attached to the control bar 106 to help develop the wrists or may be pivotably attached to reduce any rotative forces being applied to the control bar 106. Fasteners, such as bolts 112 and 114 may be used to fixedly and/or pivotably attach the outrigger bars 108 and 110 to the control bar 106.

Each outrigger bar has a pair of through holes 116 and 118 provided adjacent to each end. A loop of elastic material is threaded through the two holes 78 and 80 provided through the guide arm 72, through holes 22 provided through the alignment bar 14 and the two through holes 116 and 118 provided through the outrigger bars 108 and 110 respectively as shown.

Figure 16:
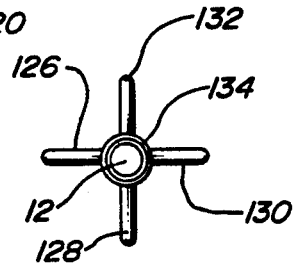
FIG. 16 is an end view of the control bar showing the details of the hand guard.
Figure 15:
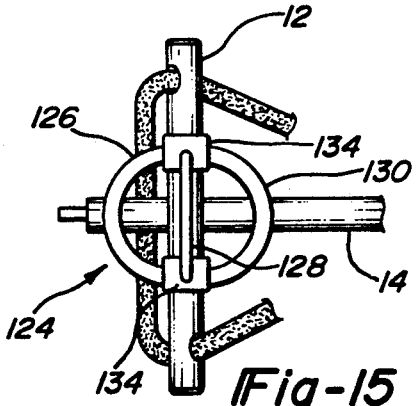
FIG. 15 is a partial top view showing a hand guard attached to the control bar.

FIGS. 15 and 16 show a hand guard 124 which is attachable to the control bar 12. The hand guard 124 has at least four semi-circular members 126–132 arranged in a cruciform pattern as shown in FIG. 16. The ends of the semi-circular members are attached to a pair of spatially separated mounting rings 134.

The mounting rings 134 are preferably rotatable about the control arm 12. The hand which of the user grasps the control bar 12 is insertable between any two adjacent semi-circular members 126–132. The cruciform guard 124 protects the hand from accidental or inadvertent engagement With the end of the alignment bar 14.

As shown in FIG. 18, the control bar 12 may also include a rotatable hand grip 160 which covers the hand grasping portion 24 thereof. The rotatable hand grip 160 is rotatably received on the control bar 12 and secured against axial displacement by a pair of pins 162 and 164 disposed on opposite ends thereof. The pins 162 and 164 are secured in appropriate pin holes disposed through the control bar as shown. The rotatable hand grip 160 better balances the forces exerted by the length of elastic material about the hands. With the use of the rotatable hand grip 160, the forces become self-aligning, eliminating the necessity of the user to fight the rotation of the control bar when exercising.

FIGS. 22 and 23 show a control bar safety guard 166 which maintains the control bar 12 in the proximity of the user's hand if the user inadvertently or accidentally looses his grip on the control bar 12. This control bar safety guard 166 prohibits the control bar 12 from being driven by the force of the elastic member into the other hand, the face, or the body of the user in the event the user loosed his or her grip on the control bar. The control bar safety guard 166 has an outer loop portion 168, and an inner loop portion 170 which extends through the outer loop portion at approximately a 90° angle. Coil portions 172 and 174 join the ends of the outer loop portion 168 to the corresponding ends of the inner loop portion 170. The coil portions 172 and 174 circumscribe the control bar 12 and rotatably secure the control bar safety guard 166 to the control bar 12. The user's hand is inserted between the outer loop portion 168 and the inner loop portion 120 in the direction indicated by arrow 176 in FIG. 23. The user can then grasp the control bar 12 between the coils 172 and 174 in a normal manner. In the event the user looses his grip on the control bar 12, the control bar safety guard 166 will lock on the user's wrist inhibiting any substantial displacement of the control bar from the hand from which it slipped.

A corresponding alignment bar safety guard 178 is shown in FIGS. 24 and 25. The alignment bar safety guard 178 has a pair of looped portions 180 and 182. The ends of the looped portions 180 and 182 respectively are joined together by U-shaped portions 184 and 186 which are contoured to mate with the external curvature of the alignment bar 14 as shown in FIG. 25. Elastic bands 188 and 190 secure the alignment bar safety guard 178 to the alignment bar 14 as shown. The user's hand is inserted through either looped portion 180 or 182 prior to gripping the alignment bar 12, depending on whether the alignment bar is being gripped by the right or left hand.

In the use of the performance alignment reaction tool, the control bar and alignment bar safety guards provide the following features:

1. They rotate with the action of the hand and wrist without hindering their movement.
2. The are capable of moving along the control or alignment bar as the hand position changes.
3. They are strong enough to withstand the forces when the control or alignment bar slips from the user's grasp.
4. They contain the bar in the event the bar slips from the user's hand.

5. The user's hand is easily inserted into the control bar and alignment safety guards permitting the hands to be easily interchanged from one bar to the other.

Counter balance weights 192 and 194 may be added to one or both ends of the alignment bar as shown in FIGS. 19 and 20. The counter balance weight 192 which protrudes from one end of the alignment bar 14 weight 192 is mounted on a threaded shaft 196. The counter balance weight 192 is locked in the desired location along the thread shaft 196 by a pair of lock nuts 198 and 200. In a like manner, counter balance weight 194 is mounted on a thread shaft 202 protruding from the other end of the alignment bar 14. The counter balance weight is secured in the desired location between a pair of nuts 204 and 206. The nuts 198, 200, 204 and 206 permit the location of the counter balance weights 192 and 194 to be changed as desired. As shown in FIG. 20, a third counter balance weight 208 may be added to either or both ends of the alignment bar. In addition to the axially disposed counter balance weights 192 and 194, a radially disposed counter balance weight 210 may be added to the alignment bar 12 as shown in FIG. 20. The radially disposed counter balance weight 210 is mounted on a threaded shaft 212 between a pair of nuts 214 and 216. The threaded shaft 212 is received in a hole diametrically disposed through the alignment bar 12 and is locked therein by a pair of nuts 218 and 220. Alternatively, the threaded shaft 212 may be threaded into a threaded bore provided in the alignment bar 14, or may be mounted to the alignment bar using any method known in the art.

The counter balance weights are positioned about the alignment bar 12 so that the individual user can systematically adjust the balancing forces about the wrists and hands so that the individual user can enjoy an even, well-balanced action when using the performance alignment reaction tool.

In controlling the rotational action of the alignment bar 14, a pair of counter balance weights 222 and 224 may be mounted on a threaded shaft 226 extending through the alignment bar 14 as shown in FIG. 21. The threaded shaft 226 is preferably parallel to the guide arm 72 and is located adjacent to end of the hand grasping portion 26 of the alignment bar 12. The counter balance weights 222 and 224 are secured to the threaded shaft 226 by nuts 228 and 230 respectively. The counter balance weights 222 and 224 give the user a more fluid balanced control action.

Prior to discussing methods of exercise using the performance alignment reaction tool, a brief discussion of muscular skeletal alignment technology (M-SAT) is helpful.

Muscular skeletal alignment technology (M-SAT) was developed as the discovery of vault lines became better understood. A vault line exists when the arms and hands follow the present stability line that is set by the legs and feet. In years past, they were called "magic points" or that an athlete was "in the groove". When an individual takes advantage of their vault lines, he enjoys optimum speed, power, control, stability and consistency about the hand and arm. Individuals who have played baseball at any level, can remember when they hit the ball an unbelievable distance, compared to what they normally could. They accomplished this, with what they felt was less effort than normal. In technical terms, the individual aligned his hands and arms on the preset line that was set by the feet and legs, gaining the preset lines force, power and stability. In short, the individual-enjoyed optimum performance due to alignment of feet and legs, compared to just using the force, power and stability of the upper body.

During movement, regardless whether it be walking or playing professional athletics, the body tries to use vault lines as they are the most effective and efficient way of doing things. There are a great number of situations that deter the body from following its natural vault lines or natural symmetry.

The following is a partial list of conditions that affect all humans regardless of their profession.

1. Perceptual problems such as eye malfunctions.
2. Injury to the body.
3. Deterioration of the body due to aging.
4. Daily work movements.
5. Lifestyle.
6. Improper posture.
7 Inactivity of an individual.

These conditions place stress on the muscular and skeletal structure of the body. Over a prolonged period of time they lead to misalignment of their skeletal structure, particularly the individuals spine, which can cause anything from back pain, muscle spasms, numbness in limbs, irregular digestive moments, disease etc. Over the centuries, the medical profession has confirmed, that our overall health is a direct reflection of the structure and state of the spine.

The purpose of M-SAT is to develop a muscular structure that will restore the individuals skeletal structure to a state that will enable the individual to enjoy a well balanced and functional range of motion. M-SAT's main target is the back and neck area, where concentration is centered in the structural alignment of the spine. In layman terms, M-SAT develops the strongest and most functional back available to humans today.

The key to building functional, range and motion (FRM) and proper skeletal makeup comes as a result of Vault Lines. Practical application has confirmed that optimum performance is a direct result of vault lines, and that optimum performance requires optimum skeletal alignment. For individuals who suffer from skeletal misalignments, the answer is in having them follow proper vault lines. The function of the performance alignment reaction tool is to develop muscular actions and reactions along these vault lines. Through use of the performance alignment reaction tool in a prescribed method of exercise the individual aligns his skeletal makeup properly, as well as building the required muscular structure to keep it in place.

The performance alignment reaction tool is extremely useful for individuals who suffer from skeletal structure misalignments, as well as athletes who continually become misaligned due to the continual bumps and bruises sustained during competition.

Another concept that should be discussed is the functional range of motion (FRM), which is the ability to use the body functionally about the individuals full range of motion, or to be effective with the body in any direction.

To develop a functional range of motion the individual must train the body along all possible lines and angles, the very thing that the performance alignment reaction tool was designed to do. The results of developing a FRM is that the individual gains a well balanced muscular structure that supports the skeletal makeup.

M-SAT's function is to work alignment first and muscular structure second, rather than what is typically accomplished during traditional exercise. Exercising the muscles not taking body alignment into account, places stress on the skeletal structure which can lead to misalignment and unbalance the muscular structure. This approach is seen in cardiovascular type exercise as well as weight training type exercise.

The scope of M-SAT is far reaching and broad in practically. Professional athletes gain a full range of strengthened movement (functional range of motion) to enhance their abilities to act and react. They train with speed and power as the priority so that they will be able to react 3 to 8 times per second with ultimate effectiveness, the very thing that is required in their professional sport. Middle age and older individuals develop a functional range of motion for the purpose of correcting past problems, staying in shape and for general health reasons. Their emphasis is primarily on alignment keeping the body healthy and functional so that they can enjoy all the endeavors they wish to participate in.

M-SAT is a visual/mental/physical process that utilizes the alignment of an individuals vault lines to develop a well balanced muscular and skeletal structure throughout the body. the performance alignment reaction tool provides the opportunity to develop any and all reaction lines and angles that exit about the body. M-SAT's aim is to develop the function and operation of the body throughout the individuals full range of movement, which translates into a person enjoying improved:

coordination
speed
power
balance
flexibility
hand relativity; and
fluidity

Figure 29A:
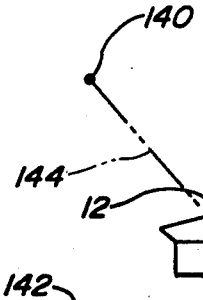
Figure 29B:
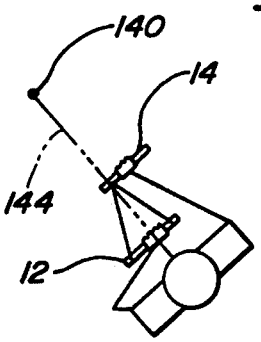
Figure 29C:
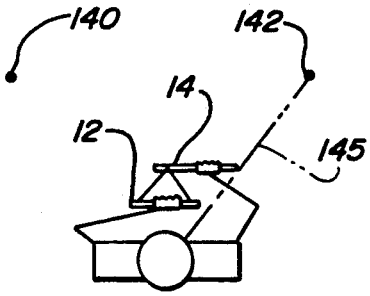

To ensure the performance alignment reaction tool is properly used, the individual user should use his entire body. The individual user will grasp the alignment bar in one hand and the control bar in the other hand, as shown in FIG. 29*a* then sight a predetermined point within his or her range of motion. Upon sighting a point, such as point 140, the user will move one hand toward the point 140 holding the other hand in its original position as shown in FIG. 29*b*. Upon sighting the second point such as point 142, the user will return the one hand to its original position as shown in FIG. 29*c* then move the other hand toward the new point as shown in FIG. 17*d*. During this movement the hands will cross at 90° angles to each other and the non-extended hand will take a position adjacent to the body previously occupied the extended hand. The users knees will mirror the action of the hands and the body will pivot, as shown. The individual will feel his body working as a unit, as he moves the alignment bar 14 and control bar 12 back and forth. This action is aerobic in nature. Due to the configuration of the performance alignment reaction tool, the user develops perfect alignment every time he acts and reacts. The use of the performance alignment reaction tool conforms to how the body moves which make them very adaptable to a variety of situations in exercise and in sport. A dancer stands on one foot and gracefully moves through her range of movements using the performance alignment reaction tool to train in the manner that he or she is accustom to. Alternately, a fitness buff moves his or her body about in a very calculating way, as he or she would when doing calisthenics. The performance alignment reaction tool was designed to conform to the movement of the body which makes it adaptable to many sporting situations. The main purpose of M-SAT using the performance alignment reaction tool is to develop an individual's functional range of motion.

The actual movement that is used when reacting with the performance alignment reaction tool requires the user to perform 3 basic functions:

1. The user will first sight a point with his eyes to define a principle line of reaction. The user will keep his eyes focused on this initial point until the reaction is complete.

2. Use the entire body, minus one hand called the free hand, to set a preset line of stability that corresponds to the point the individual has chosen.

3. React along the principle line of reaction with the free hand, by moving the free hand towards the chosen point.

When using the performance alignment reaction tool in the manner described above, the user is forced to use his legs a great deal. The user will find that his hands will cross each other at 90° angles and will follow the reaction lines that are set by his or her feet and knees. The user will find himself or herself on the balls of their feet working with the performance alignment reaction tool rather than trying to muscle the devices. The user may feel like a boxer, dancer, aerobic instructor or gymnast. In technical terms, the user is positioning or aligning his body in a manner that allows for the easiest and most effective movement of the performance alignment reaction tool, as he is working his or her vault lines.

The following are different types of exercises that may be performed with the performance alignment reaction tool:

CROSSING ACTION

1. Choose a desired or comfortable foot position.

2. Grasp the control bar in your left hand and the alignment bar in your right hand as shown in FIG. 29*a*.

3. Sight a point such as point 140 on the one side of the body, such as the left side of the body. The point 140 can be a random point, or a point on a M-SAT pattern as shall be described hereinafter.

4. With the alignment bar in your right hand, set it and your body towards the intended point as shown in FIG. 29*b*. Your left hand holding the control bar will tend to stay close to the body. The action will set up a resultant line of force 144 in which the alignment bar can react around, which is your right hand.

5. Move your right hand, which is holding the alignment bar 14, toward the chosen point as shown in FIG. 29*b*.

Figure 29D:
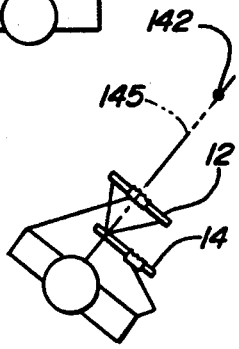

6. Having completed this action, choose a point on the opposite or the right side of your body and repeat the same action as shown in FIGS. 29*c* and 29*d*. This time the right hand and alignment bar will be close to the body and will set a resultant line of force 145 which the left hand and control bar will react around as shown in FIG. 29*d*. If executed correctly, the hands cross each other at 90° angles.

7. Repeat this crossing action, based on your intended fitness program.

8. Periodically turn the device around where the right hand will have the alignment bar in it, and the control bar will be in the left hand.

OPEN ACTION

This movement is performed in the same manner as the crossing action, with one change. Choose points which are close together and that will not result in the hands crossing each other. You may notice this action resembles someone dancing or performing aerobics.

A noticeable difference will take place when we set our body and stabilizing arm, which creates the resultant line of force. Instead of the stabilizing arm being close to the body, as in the crossing action, the individual will find it across the body extended approximately toward the elbow of the reacting hand. As in the crossing section, reverse the hand position on the devices so you enjoy a well balanced workout.

DIRECTED ACTION

The directed action is a specific implementation of the open action in which the user moves the control bar and alignment bar back and forth, toward one point only. The users body will twist and turn and manipulate itself in many positions while focusing on this one point.

CONSTRAINED MOVEMENT

In the constrained movement, the user can vary crossing, open and directed actions while keeping the elbows tight to the body. The resultant movement tends to give the legs and lower mid section more exercise as virtually all power and movement must be generated from these areas.

The above exercises may be performed with the feet and legs in various positions to emphasize the development along a desired vault line. The various leg and feet positions include feet together, legs spread apart to shoulder width, legs spread wide apart, legs crossed or standing on one leg. The exercise may also be performed while walking, running or any other type of movement.

The above leg and feet positions and action movements are not meant to encompass all the possibilities of how the devices can be used. As for every sport there are different reaction lines and stances to be developed. However, the following procedures are certainly enough for a normal individual looking for a functional range of motion.

TENSION

The tension that exists between the control and alignment bars by the loop of elastic material is directly proportional to the type of development desired. Light tension will result in light muscular development and heavy tension results in heavy muscular development. In deciding what is the right tension the general rule of thumb is that an individual should be able to manipulate the symmetry sticks at least 35 to 40 times, before the muscles are fatigued. Once an individual is able to manipulate the tool 100 to 130 times, the tension may be increased if desired. The final decision on tension strength, will be answered based on whether the individual is looking for a cardiovascular workout, weight lifting workout or just trying to maintain their muscular structure they already have.

MUSCULAR SKELETAL ALIGNMENT TECHNOLOGY (M-SAT) PATTERS

To develop a functional range of motion (FRM) systematically, a set of M-SAT patterns may be used. A starting pattern may be a simple frontal pattern 146 as shown in FIG. 30. This frontal pattern may be mountable to a wall or printed on a self standing structure. The pattern may be from 6 to 10 feet in height and 6 to 12 feet wide. The pattern is preferably divided into at least nine (9) areas of equal size and each area has a numeral which functions as an aiming point providing a line of sight for the movement of the symmetry exercise sticks.

In the exercise, the user will stand in front of the frontal pattern 146 and alternately extends the alignment bar and control bar towards numeral 1 then return the alignment bar to a position adjacent to his or her body. In the second movement, the user will extend the control bar towards numeral 2 then return it to a position adjacent to his or her body. This exercise will be repeated, extending the alignment bar then the control bar to the next highest numeral until the numerical sequence is completed. The user will then start all over again.

After mastering the simple frontal pattern shown in FIG. 30, the user may progress to an advanced frontal pattern 148 such as shown in FIG. 31. The advanced frontal pattern 148 may also contain nine areas as shown, however more than one numeral may be contained in each area. The size of the numeral may be varied, as shown, to indicate the priority and difficulty of each aiming point in the pattern.

After mastering the immediate frontal pattern, a more advanced 3-dimensional pattern 150 such as shown on FIG. 32 may be used. This advanced pattern 150 has a frontal panel 152 and a pair of side panels 154 and 156 extending substantially parallel to each other in a direction towards the user, from each end of the frontal panel. Like the simple and intermediate frontal patterns, the frontal and side panels of the advance pattern are divided into a plurality of areas, each area having at least one numeral which as in the prior patterns identifies an aiming point. Again, in the use of the performance alignment reaction tool, the alignment and control bars are extended and withdrawn in an alternating manner toward each numeral, in the indicated numerical sequence.

Ideally a fourth panel, (not shown) may be added to the advanced pattern providing a full 360° range of motion of the user. As a result of using the M-SAT patterns at various speeds, the user will begin to see a direct correlation of how operational and functional the body can become. The user can make the execution of any pattern more difficult by having to perform it under a time constraint.

Other variations an individual will notice in M-SAT patterns is "loading". When we load a pattern, we work one particular area so that the area will be strengthened. This is typically done if the individual wants to repair a damaged area. Random or rhythm patterns give benefits based on your interest. Dancers typically look for rhythm patterns while a football linebacker's reaction is based on random patterns. Patterns should be chosen based on particulars of goals. A 60 year old would more than likely focus on range and control where his primary interest is in stability of his range of motion. The young athlete is predominantly interested in speed and transition of movement throughout his range of motion, as that is what is required in his area of interest.

Having described the various embodiments of the performance alignment reaction tool and exercise routines using the performance alignment reaction tool with and without patterns, it is recognized that those skilled in the art will be able to make improvements as well as design alternate embodiments within the spirit of the invention as described herein and set forth in the claims.

What I claim is:

1. A performance alignment reaction tool comprising:

a control bar;

an alignment bar substantially normal to said control bar, said control bar and said alignment bar are cylindrical bars having an axis of symmetry; and means for elastically connecting at least one intermediate location on said alignment bar to spatially separated locations on said control bar, said means for elastically connecting comprises:

said control bar having at least one pair of through holes provided therethrough normal to said axis of symmetry of said control bar, said alignment bar having at least one hole provided therethrough normal to said axis of symmetry of said alignment bar; and a length of elastic material connecting each hole of said pair of through holes provided through said control bar to said at least one hole provided through said alignment bar, said control bar and said length of elastic material forming an isosceles triangle in which said hole provided through said alignment bar is the apex of said isosceles triangle.

2. The tool of claim 1, wherein said holes in at least one pair of holes provided through said control bar are perpendicular to each other.

3. The tool of claim 1, wherein said control bar has a centrally disposed pin aperture and said alignment bar has a pin longitudinally extending from one end thereof, said pin rotatably received in said pin aperture.

4. The tool of claim 1, further having a radially extending guide arm symmetrically attached to one end of said alignment and wherein said means for elastically connecting further includes means for attaching said spatially separated locations on said control bar to spatially separated locations on said guide arm.

5. The tool of claim 1, wherein said means for elastically connecting said control bar to said alignment bar comprises at least two independent loops of elastic material connecting at least two locations on said alignment bar with spatially separated locations on said control bar.

6. The tool of claim 1, wherein said means for connecting further connects said two spatially separated locations on said control bar to a second location on said alignment bar adjacent one end thereof.

7. The tool of claim 1, wherein said length of elastic material is a continuous loop of elastic material in which a portion of said loop of continuous loop of elastic material extends between said at least one pair of holes provided through said control bar.

8. The tool of claim 7 wherein said loop of elastic material comprises a loop of solid elastic material enclosed in a loop of tubular elastic material and wherein the modules of elasticity of said loop of solid elastic material is greater than the modules of elasticity of said loop of tubular elastic material.

9. The tool of claim 7, wherein said loop of elastic material comprises a loop of tubular elastic material and a coiled loop of nylon enclosed within said loop of tubular elastic material.

10. The tool of claim 7, wherein said at least one pair of holes provided through said control bar comprises a first set of holes and a second set of holes spatially separated from said first set of holes and said at least one hole provided through said alignment bar is a third set of holes.

11. The tool of claim 10, wherein said second set of holes are disposed at 90° to said first set of holes.

12. The tool of claim 10, wherein said first set of holes are provided adjacent to one end of said control bar and said second set of holes are provided adjacent to an opposite end of said control bar.

13. The tool of claim 10, wherein said first set of holes are provided adjacent to one end of said control bar and said second set of holes are provided at a location intermediate said one end and an opposite end of said control bar.

14. A performance alignment reaction tool comprising:

a control bar;

an alignment bar substantially normal to said control bar;

a radially extending guide arm symmetrically attached to one end of said alignment bar; and means for elastically connecting at least one intermediate location on said alignment bar to spatially separated locations on said control bar, said means for elastically connecting further includes means for attaching said spatially separated locations on said control bar to spatially separated locations on said guide bar.

15. The tool of claim 14, wherein said guide arm is rotatably attached to said alignment bar.

16. The tool of claim 14, further comprising:

at least one weight; and means for attaching said at least one weight to said alignment bar.

17. The tool of claim 14, wherein said means for elastically connecting comprises:

said control bar having a first set of through holes provided at one end thereof and a second set of through holes provided at the opposite end thereof:

said alignment bar having a third set of through holes provided therethrough at an intermediate location;

said guide arm having at least one through hole provided adjacent to each end; and a length of elastic material connecting a respective one of said first set, said second set, and said third set of holes, and said at least one hole provided adjacent each end of said guide arm, said length of elastic material elastically holding said control bar and guide arm parallel to each other and said alignment bar substantially normal to said control bar and guide arm.

18. The tool of claim 17, wherein said control bar further includes an outrigger bar attached to each end of said control bar, each outrigger bar being disposed normal to said control bar, and wherein said first set of holes and said second set of holes are provided in said outrigger bar.

19. The tool of claim 17, wherein said loop of elastic material passes through a respective one of said third set of holes in said alignment bar between said at least one holes provided adjacent to the ends of said guide arm.

20. The tool of claim 19, further comprising a tension pin attached to said alignment bar, said tension pin disposed at a location intermediate said guide arm and said respective one of said third set of holes provided through said alignment bar and extending radially in opposite directions therefrom said tension pin allowing the portion of said length of elastic material between said respective one of said third set of holes provided through said alignment bar and said guide arm to be wound therein to increase the tension of said length of elastic material.

21. A performance alignment reaction tool comprising:

a control bar having a centrally disposed pin aperture;

an alignment bar substantially normal to said control bar, said alignment bar having a pin longitudinally extending from one end thereof, said pin being rotatably received in said pin aperture of said control bar; and means for elastically connecting at least one intermediate location on said alignment bar to spatially separated locations on said control bar.

22. The tool of claim 10, wherein said loop of elastic material passes through a respective one of said first, second, and third set of holes.

* * * * *